US006792911B2

(12) United States Patent
Resh et al.

(10) Patent No.: US 6,792,911 B2
(45) Date of Patent: Sep. 21, 2004

(54) SYSTEM AND METHOD FOR CONTROLLING THE FLOW OF OIL IN AN ENGINE

(75) Inventors: William F Resh, Lansing, MI (US); Wei Tao, Troy, MI (US)

(73) Assignee: DiamlerChrysler Corporation, Auburn Hills, MI (US)

( * ) Notice: Subject to any disclaimer, the term of this patent is extended or adjusted under 35 U.S.C. 154(b) by 50 days.

(21) Appl. No.: 10/304,377

(22) Filed: Nov. 26, 2002

(65) Prior Publication Data

US 2004/0099240 A1 May 27, 2004

(51) Int. Cl.[7] ..... F01M 1/00
(52) U.S. Cl. ..... 123/196 R
(58) Field of Search ..... 123/196 R

(56) References Cited

U.S. PATENT DOCUMENTS 3,144,010 A * 8/1964 Slooten ..... 123/90.35

* cited by examiner

*Primary Examiner*—Noah P. Kamen
(74) *Attorney, Agent, or Firm*—Thomas A. Jurecko

(57) ABSTRACT

A system for controlling the flow of engine oil in a cylinder block that houses hydraulic lifters. The system includes a lifter gallery extending through the cylinder block, such that each of the hydraulic lifters are in fluid communication with the lifter gallery. The system also includes a flow restriction element for restricting the flow of the engine oil through at least a portion of the lifter gallery. Specifically, the flow restriction element is configured to be inserted into either a lifter gallery inlet opening or the lifter bores in order to reduce the cross-section of the lifter gallery and restrict the flow of engine oil through the lifter gallery.

16 Claims, 3 Drawing Sheets

SYSTEM AND METHOD FOR CONTROLLING THE FLOW OF OIL IN AN ENGINE

FIELD OF THE INVENTION

The present invention relates to oil flow in an engine. More specifically, the present invention relates to a system and method for controlling the flow of engine oil in a cylinder block of an engine.

BACKGROUND INFORMATION

A conventional engine in a motor vehicle includes a cylinder block having a number of cylinder bores that house pistons. Each cylinder has a valvetrain associated with it, including intake and exhaust valves. There is a hydraulic lifter for each valve, located in chambers, referred to as lifter bores, which are adjacent to the respective cylinders. A lifter gallery that extends most of the length of the cylinder block intersects with each of the lifter bores.

The lifter gallery is usually produced during manufacturing of the cylinder block by drilling through the cylinder block. Due to the length of the cylinder block, and in order to minimize the likelihood that the drill bit used to drill the lifter gallery will break during drilling, the size of the drill bit must have a substantial diameter, typically in the range of 7 to 12 mm. As a result, the lifter gallery also has a relatively large diameter, e.g., in the range of 7 to 12 mm. However, the flow of oil typically required to be provided to the valve lifters is minimal.

Thus, there is a need to provide a system and method that improves the control of engine oil flow in the cylinder block of an engine.

It is therefore an object of the present invention to provide a system and method that improves the control of engine oil flow in the cylinder block of an engine.

It is another object of the present invention to provide a system and method that enables the use of a smaller oil pump than would otherwise be required.

It is another object of the present invention to provide a system and method that reduces the power losses that result from the aeration of engine oil caused by the excessive flow of engine oil in the cylinder block of an engine.

SUMMARY OF THE INVENTION

The above and other beneficial objects of the present invention are achieved by providing a system and method as described herein. The present invention, according to one example embodiment thereof, relates to a system for controlling the flow of engine oil in a cylinder block that houses hydraulic lifters. The system includes a lifter gallery extending through the cylinder block, such that each of the hydraulic lifters are in fluid communication with the lifter gallery. The system also includes a flow restriction element for restricting the flow of the engine oil through at least a portion of the lifter gallery. Specifically, the flow restriction element is configured to be inserted into either a lifter gallery inlet opening or the lifter bores in order to reduce the cross-section of the lifter gallery and restrict the flow of engine oil through the lifter gallery.

DETAILED DESCRIPTION

Figure 1:
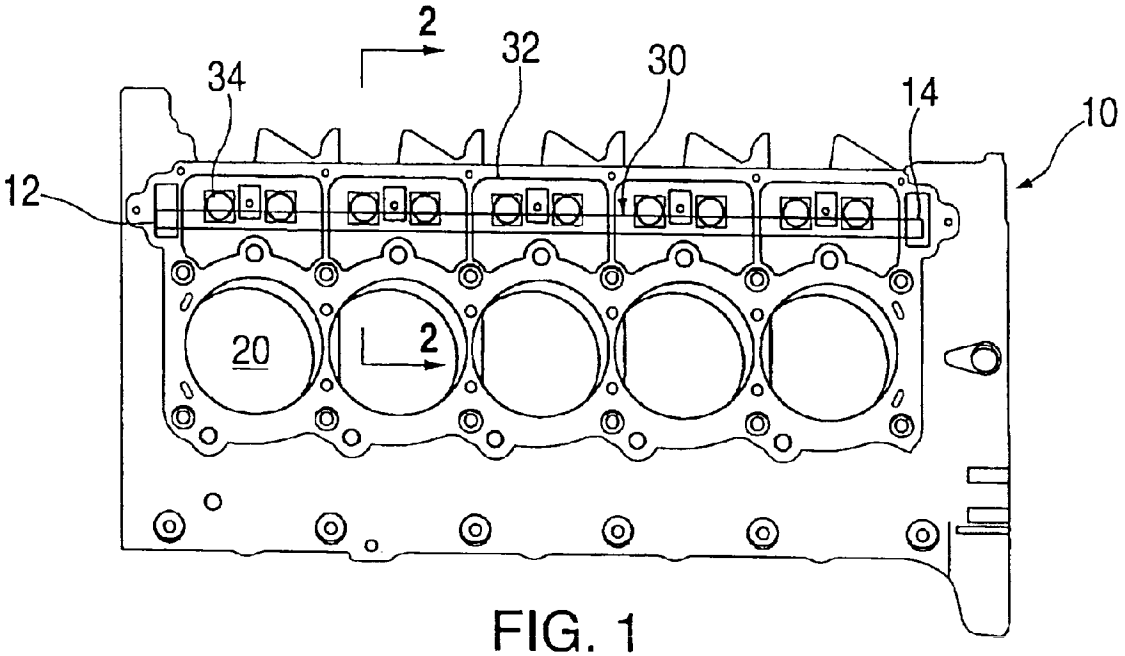
FIG. 1 is a cross-sectional view that illustrates part of a cylinder block of an engine, in accordance with one example embodiment of the present invention.

FIG. 1 is a cross-sectional view that illustrates part of a cylinder block of a V-10 engine. Specifically, FIG. 1 illustrates a portion of a cylinder block 10 having five cylinder bores 20 (the remaining five cylinder bores of a V-10 engine are housed in an opposite side of the cylinder block). Each of the cylinder bores 20 houses a piston.

Figure 2:
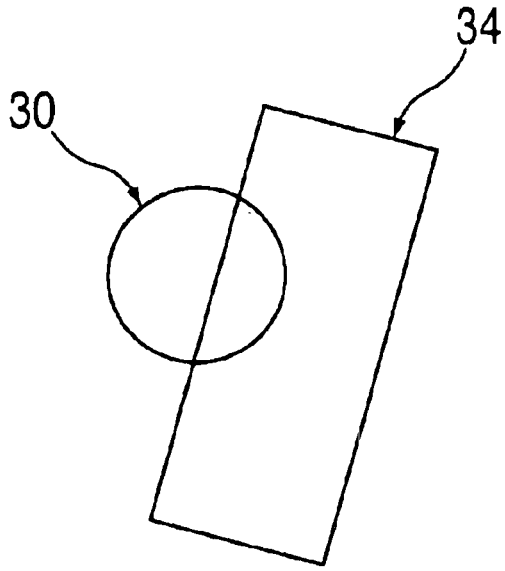
FIG. 2 is a cross-sectional view, taken along lines 2—2 of FIG. 1, that illustrates the intersection of the lifter gallery with a lifter bore, in accordance with one example embodiment of the present invention.

Disposed adjacent to each of the cylinder bores 20 is a lifter gallery 30 that extends substantially the entire length of the cylinder block 10. More specifically, the lifter gallery 30 extends from a lifter gallery inlet opening 12 to a closed or blind end 14. As shown, the lifter gallery 30 is surrounded by several lifter gallery chambers 32, each corresponding to a respective one of the cylinder bores 20. In addition, each lifter gallery chamber 32 includes a pair of lifter bores 34. The first lifter bore 34 of each lifter gallery chamber 32 houses a hydraulic intake lifter, while the second lifter bore 34 of each lifter gallery chamber 32 houses a hydraulic exhaust lifter. Each lifter bore 34 intersects with the lifter gallery 30 so as to be in fluid communication therewith. FIG. 2 is a cross-sectional view, taken along lines 2—2 of FIG. 1, that illustrates the intersection of the lifter gallery 30 with a lifter bore 34, according to one example embodiment of the present invention.

Figure 3:
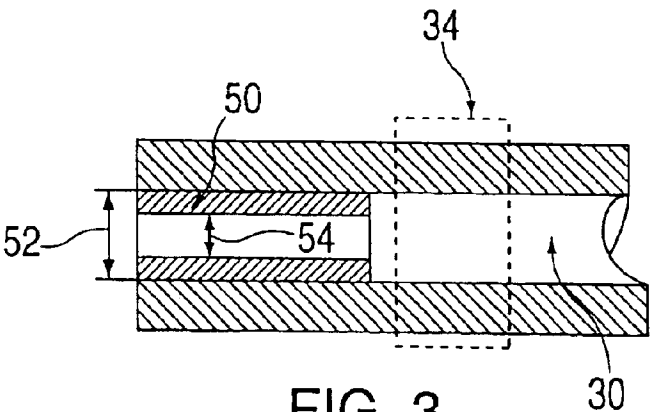
FIG. 3 illustrates a flow restriction element, according to one example embodiment of the present invention.

Due to the use of a large drill bit in order to produce the lifter gallery 30 during the manufacture of the cylinder block 10, the lifter gallery 30 has a relatively large diameter, typically in the range of 7 to 12 mm. In order to control the flow of oil through the lifter gallery 30, the present invention, according to various example embodiments thereof, provides at least one flow restriction element made of plastic or any other suitable material. FIG. 3 illustrates a flow restriction element 50, according to one example embodiment of the present invention, that is configured to be inserted into the lifter gallery inlet opening 12. The flow restriction element 50 has an outside diameter 52 that is substantially equal to the inside diameter of the lifter gallery inlet opening 12, thereby enabling the flow restriction element 50 to be press-fitted into the lifter gallery inlet opening 12. In addition, the flow restriction element 50 has an inside diameter 54 that is smaller than the inside diameter of the lifter gallery inlet opening 12, thereby reducing the cross-sectional area of the lifter gallery inlet opening 12, and effectively reducing the amount of oil that may flow through the lifter gallery inlet opening 12.

Figure 4:
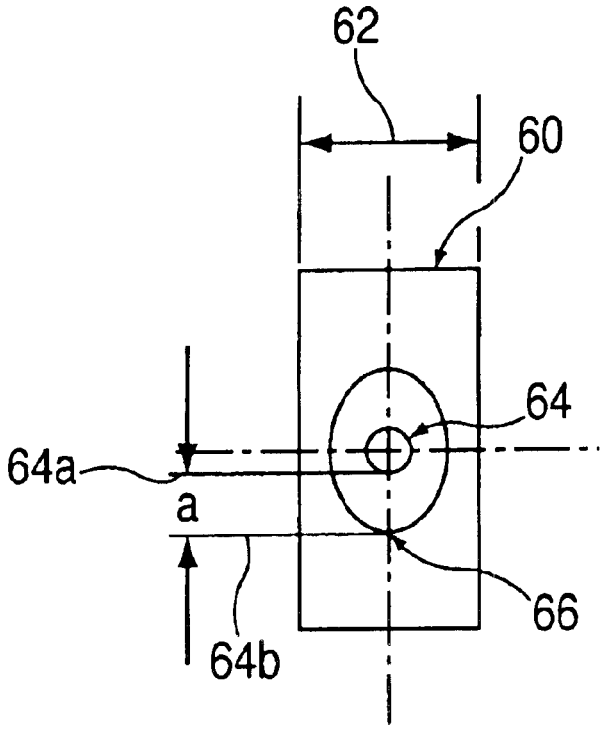
FIG. 4 illustrates a flow restriction element, according to another example embodiment of the present invention.

FIG. 4 illustrates a flow restriction element 60, according to another example embodiment of the present invention, that is configured to be inserted into at least one, but, e.g., all, of the lifter bores 34. The flow restriction element 60 has an outside diameter 62 that is substantially equal to, or slightly smaller than, the inside diameter of the lifter bore 34, thereby enabling the flow restriction element 60 to be press-fitted into the lifter bore 34. In addition, the flow restriction element 60 has an orifice 64 through which oil may flow. The orifice 64 of the flow restriction element 60 provides a cross-sectional area that is smaller than the cross-sectional area of an orifice 66 provided by the intersection of the lifter gallery 30 and the lifter bore 34, thereby effectively reducing the amount of oil that may flow between the lifter gallery 30 and the lifter bore 34.

Figure 5:
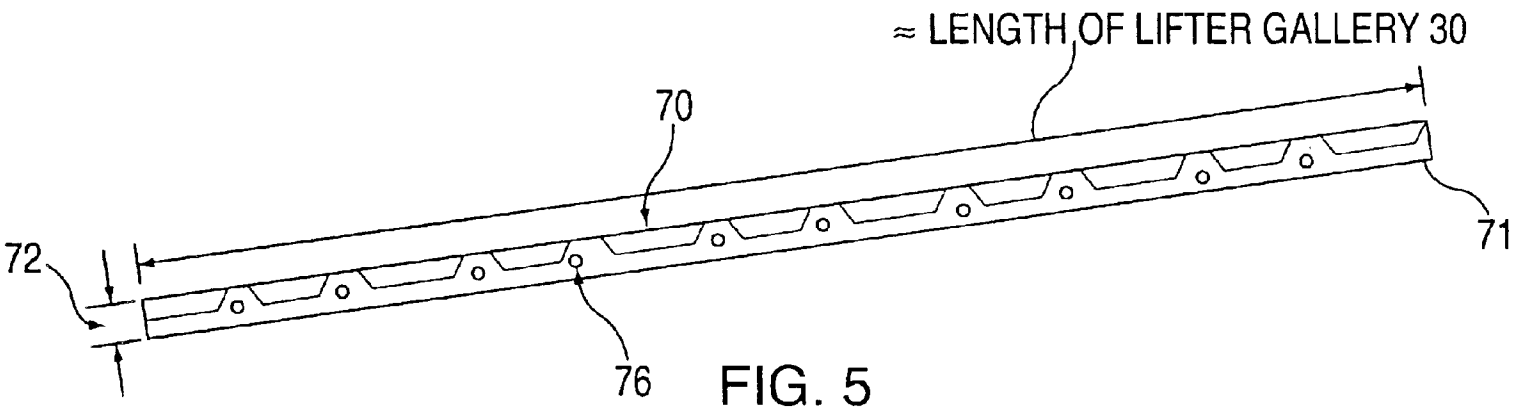
FIG. 5 illustrates a flow restriction element, according to still another example embodiment of the present invention.

FIG. 5 illustrates a flow restriction element 70, according to still another example embodiment of the present invention, that is configured to be inserted into the lifter gallery inlet opening 12. Unlike the flow restriction element 50 shown in FIG. 3, however, the flow restriction element 70 shown in FIG. 5 has a length that extends substantially the entire length of the lifter gallery 30. The flow restriction element 70 includes a plurality of orifices 76. When the flow restriction element 70 is fully inserted into the lifter gallery 30, each of the orifices 76 of the flow restriction element 70 is axially aligned with a respective lifter bore 34 so as to enable the flow of oil between the lifter bore 34 and the cylinder bore 20 through the orifices 76. In order to ensure that the orifices 76 of the flow restriction element 70 are rotationally aligned with the lifter bores 34, the flow restriction element 70 may also include indicia, such as index 78. When the index 78 is aligned with a corresponding index, such as index 38, on the cylinder block 10, correct rotational positioning of the flow restriction element 70 relative to the cylinder block 10 (and thus the lifter bores 34 provided by the cylinder block 10) may be assured.

Figure 6:
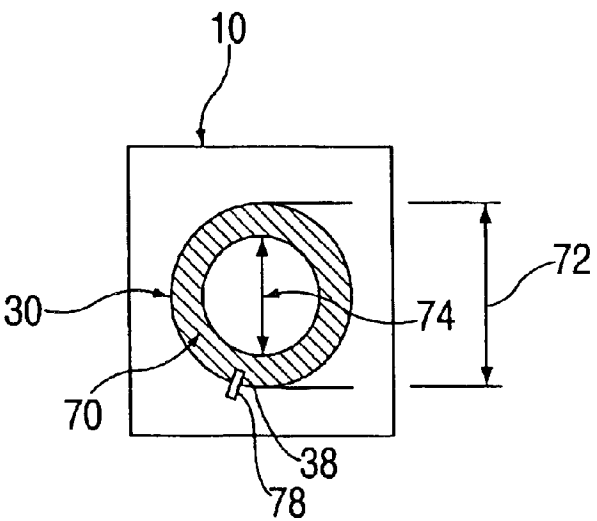
FIG. 6 illustrates a cross-sectional view of the flow restriction element shown in FIG. 5 as inserted within the lifter gallery.

As shown in FIG. 6, which illustrates a cross-sectional view of the flow restriction element 70 inserted within the lifter gallery 30, the flow restriction element 70 has an outside diameter 72 that is substantially equal to, or slightly smaller than, the inside diameter of the lifter gallery 30, thereby enabling the flow restriction element 70 to be press-fitted into the lifter gallery 30. In addition, the flow restriction element 70 has an inside diameter 74 that is smaller than the inside diameter of the lifter gallery 30, thereby reducing the cross-sectional area of the lifter gallery 30 and effectively reducing the amount of oil than may flow through the lifter gallery 30.

Figure 7:
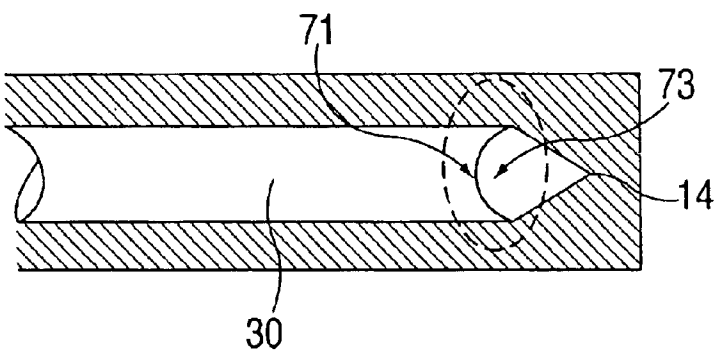
FIG. 7 illustrates a cross-sectional view of one end of the flow restriction element shown in FIG. 5, in accordance with one example embodiment of the present invention.

FIG. 7 is a cross-sectional view that illustrates one end of the flow restriction element 70 inserted into the lifter gallery 30, in accordance with one example embodiment of the present invention. In the example embodiment shown, the flow restriction element 70 has an end 71, for example the cup-shaped end 71 shown in FIG. 7. The end 71 may be shaped such that, when the flow restriction element 70 is fully inserted into the lifter gallery 30, the end 71 provides a distal space 73 at the blind end 14 of the lifter gallery 30. The distal space 73 may be provided to trap debris, e.g., scrap metal that maybe inadvertently left behind during the manufacturing of the cylinder block 10, that is present in the lifter gallery 30 prior to the insertion of the flow restriction element 70. In addition, in an example embodiment of the present invention, the end 71 of the flow restriction element 70 may be flexible. The flexibility of the end 71 may help to dampen any sharp increases in oil pressure, thereby reducing the tendency of the system to experience a "water hammer"-like effect when a sharp increase in oil pressure occurs.

As previously mentioned, a lifter gallery may be produced during manufacturing of the cylinder block by drilling through the cylinder block with a drill bit having a diameter in the range of 7 to 12 mm, resulting in a lifter gallery having an unnecessarily large inner diameter. The flow restriction elements of the present invention, in accordance with the various example embodiments described above, restrict the flow of oil through the lifter gallery 30, thereby providing improved oil flow control. As a result of the improvement in oil flow control, the engine may include a smaller oil pump than may be required if the flow restriction elements were not provided, and engine oil that may otherwise be used in the lifter gallery is available to be sent to other places in the engine that require engine oil. Still further, the use of the flow restriction elements may reduce the aeration of the engine oil that occurs when excessive engine oil drains past the rotating crank-shaft and the loss of the power that results from the aeration of the engine oil.

The flow restriction element 50 shown in FIG. 3, which merely restricts the flow of engine oil through the lifter gallery inlet opening 12, may cause the lifter gallery 30 to experience a pressure drop between the lifter gallery inlet opening 12 and the closed end 14 of the lifter gallery 30. The flow restriction element 60 shown in FIG. 4, which restricts the flow of engine oil through the lifter bores 34, may reduce the likelihood that the lifter gallery 30 will experience such a pressure drop. Specifically, the flow restriction elements 60 may be inserted in each of the lifter bores 34 along the entire length of the lifter gallery 30. Thus, the pressure experienced over the length of the lifter gallery 30 having flow restriction elements 60 inserted in each of the lifter bores 34 may be more uniform than the pressure experienced over the length of the lifter gallery 30 when a single flow restriction element 50 is inserted in the lifter gallery inlet opening 12. Since the flow restriction elements 60 may be provided in every lifter bore 34, a more uniform pressure along the length of the lifter gallery is balanced by the need to use more than one flow restriction element. For instance, for a ten-cylinder engine, twenty flow restriction elements 60 (one for each of the lifter bores 34) may be provided as compared to a single flow restriction element 50. In accordance with other example embodiments of the invention, the flow restriction elements 60 may not be provided in every lifter bore 34, and thus the number of flow restriction elements 60 may be reduced.

The flow restriction element 70 shown in FIGS. 5, 6 and 7 may also provide a more uniform pressure over the length of the lifter gallery 30, since the flow restriction element 70 extends over substantially the entire length of the lifter gallery 30. Furthermore, the flow restriction element 70 may provide that a single such element 70 is required per lifter gallery 30. Still further, the size of the inner diameter of the flow restriction element 70, e.g., when molded from plastic, may be as small as desired, thereby optimizing the pressure in the lifter gallery 30. The size of the inner diameter of the flow restriction element 70 may not need to be the same over the entire length of the flow restriction element, but may instead vary in order to provide additional uniformity of pressure over the length of the lifter gallery 30.

The flow restriction elements of the present invention, in accordance with the various example embodiments described herein, may maintain the engine oil at a higher level around the hydraulic lifters. For instance, referring to FIG. 4, the lower edge 64*a* of the orifice 64 in the lifter bore 60 is maintained at a higher elevation relative to the lower edge 66*a* of the orifice 66 defined by the intersection of the lifter gallery 30 with the lifter bore 34. Thus, after the flow restriction element 60 is inserted into the lifter bore 34, engine oil is maintained in the lifter gallery 30 to the height of the lower edge 64*a*, rather than to the height of the lower edge 66*a*, when the engine is turned off. The additional amount of engine oil maintained in the lifter gallery 30 when the engine is turned off may improve the engine performance when the engine is started up, since less oil is required to fill the lifter gallery 30.

Thus, the several aforementioned objects and advantages of the present invention are most effectively attained. Those skilled in the art will appreciate that numerous modifications of the exemplary example embodiments described hereinabove may be made without departing from the spirit and scope of the invention. Although various exemplary example embodiments of the present invention have been described and disclosed in detail herein, it should be understood that this invention is in no sense limited thereby and that its scope is to be determined by that of the appended claims.

What is claimed is:

1. A system for controlling the flow of engine oil in a cylinder block housing a plurality of hydraulic lifters, comprising:

a lifter gallery extending through the cylinder block, each hydraulic lifter arranged in fluid communication with the lifter gallery, wherein the lifter gallery includes a lifter gallery inlet opening having a cross-section arranged to allow engine oil to flow therethrough; and a flow restriction element configured to restrict a flow of the engine oil through at least a portion of the lifter gallery, the flow restriction element insertable into the lifter gallery inlet opening, the flow restriction element configured to reduce the cross-section of the lifter gallery inlet opening so as to restrict the flow of engine oil through the cross-section of the lifter gallery inlet opening.

2. The system of claim 1, wherein the lifter gallery inlet opening has a inner diameter and the flow restriction element has an outer diameter that is substantially equal to the inner diameter of the lifter gallery inlet opening so as to be insertable within the lifter gallery inlet opening, the flow restriction element including an inner diameter smaller than the outer diameter of the flow restriction element.

3. The system of claim 1, wherein the flow restriction element is plastic.

4. A system for controlling the flow of engine oil in a cylinder block housing a plurality of hydraulic lifters, comprising:

a lifter gallery extending through the cylinder block, each hydraulic lifter arranged in fluid communication with the lifter gallery;

a plurality of lifter bores in fluid communication with the lifter gallery, each hydraulic lifter disposed in a respective lifter bore; and a flow restriction element configured to restrict a flow of the engine oil through at least a portion of the lifter gallery, wherein the flow restriction element is insertable into at least one of the lifter bores.

5. The system of claim 4, wherein the system includes a plurality of flow restriction elements, each lifter bore including a respective flow restriction element.

6. The system of claim 5, wherein each flow restriction element includes an orifice having a cross-sectional area smaller than a cross-sectional area of an orifice provided by the intersection of the lifter bore and the lifter gallery.

7. The system of claim 5, wherein each flow restriction element includes an orifice having a lower edge arranged at a higher elevation than a lower edge of an orifice provided by an intersection of the lifter bore and the lifter gallery.

8. The system of claim 7, wherein the flow restriction element is configured to maintain the engine oil in the lifter gallery at a higher level relative to the level maintained in the lifter gallery without the flow restriction element inserted.

9. A system for controlling the flow of engine oil in a cylinder block housing a plurality of hydraulic lifters, comprising:

a lifter gallery extending through the cylinder block, each hydraulic lifter arranged in fluid communication with the lifter gallery, and the lifter gallery having a cross-section arranged to allow the flow of engine oil therethrough; and a flow restriction element configured to restrict a flow of the engine oil through at least a portion of the lifter gallery, the flow restriction element insertable into the lifter gallery and extending substantially the entire length of the lifter gallery, the flow restriction element configured to reduce the cross-section of the lifter gallery so as to restrict the flow of engine oil through the cross-section of the lifter gallery.

10. The system of claim 9, wherein the flow restriction element includes a plurality of orifices.

11. The system of claim 10, further including a plurality of lifter bores in fluid communication with the lifter gallery, the orifices positioned such that, when the flow restriction element is fully inserted into the lifter gallery, the orifices axially align with the lifter bores.

12. The system of claim 10, wherein the flow restriction element has indicia that, when aligned with corresponding indicia on the cylinder block, provides that the plurality of orifices in the flow restriction element are rotationally aligned with the lifter bores.

13. The system of claim 9, wherein an inner cross-section of the flow restriction element is constant over a length of the flow restriction element.

14. The system of claim 9, wherein an inner cross-section of the flow restriction element varies over a length of the flow restriction element.

15. The system of claim 9, wherein the flow restriction element has a distal end that is shaped, such that when the flow restriction element is fully inserted into the lifter gallery, the end of the flow restriction element forms a distal space in a closed end of the lifter gallery.

16. The system of claim 9, wherein the flow restriction element has a flexible distal end.

* * * * *

UNITED STATES PATENT AND TRADEMARK OFFICE

CERTIFICATE OF CORRECTION

PATENT NO. : 6,792,911 B2
APPLICATION NO. : 10/304377
DATED : September 21, 2004
INVENTOR(S) : Resh et al.

It is certified that error appears in the above-identified patent and that said Letters Patent is hereby corrected as shown below:

Title Page:

Item (75) Assignee: DiamlerChrysler Corporation

*Should be:*

Item (75) Assignee: DaimlerChrysler Corporation

Signed and Sealed this

Nineteenth Day of February, 2008

JON W. DUDAS
*Director of the United States Patent and Trademark Office*